US006846367B2

(12) United States Patent
Nam et al.

(10) Patent No.: US 6,846,367 B2
(45) Date of Patent: Jan. 25, 2005

(54) HEAT-TREATING METHOD FOR IMPROVING WEAR-RESISTANCE AND CORROSION-RESISTANCE OF CHROMIUM-PLATED STEEL SUBSTRATE

(75) Inventors: Kee-Seok Nam, Kyungsangnam-do (KR); Sik-Cheol Kwon, Kyungsangnam-do (KR); Do-Yon Chang, Kyungsangnam-do (KR); Kyu-Hwan Lee, Kyungsangnam-do (KR); Man Kim, Kyungsangnam-do (KR); Dong-Soo Kim, Kyungsangnam-do (KR); Gun-Hwan Lee, Kyunggi-do (KR)

(73) Assignee: Korea Institute of Machinery & Materials, Daejeon (KR)

( * ) Notice: Subject to any disclaimer, the term of this patent is extended or adjusted under 35 U.S.C. 154(b) by 0 days.

(21) Appl. No.: 10/364,832

(22) Filed: Feb. 11, 2003

(65) Prior Publication Data

US 2004/0099344 A1 May 27, 2004

(30) Foreign Application Priority Data

Nov. 25, 2002 (KR) ..... 10-2002-0073440

(51) Int. Cl.[7] ..... C23C 8/30

(52) U.S. Cl. ..... 148/217; 148/218; 148/277; 148/287

(58) Field of Search ..... 148/217, 218, 148/277, 287

(56) References Cited

U.S. PATENT DOCUMENTS 3,634,147 A * 1/1972 Helwig et al. ..... 428/640
3,748,195 A * 7/1973 Kondo et al. ..... 148/218
4,054,174 A * 10/1977 Haller ..... 165/133
4,242,151 A * 12/1980 Leveque ..... 148/217
4,563,223 A * 1/1986 Dawes et al. ..... 148/217
5,906,688 A * 5/1999 Ohmi ..... 148/284

FOREIGN PATENT DOCUMENTS

JP 2001-73190 * 3/2001

* cited by examiner

*Primary Examiner*—George Wyszomierski
(74) *Attorney, Agent, or Firm*—Cooper & Dumham LLP

(57) ABSTRACT

Disclosed is a method for improving the wear- and corrosion-resistance of a chromium-plated steel substrate by heat-treating the chromium-plated steel substrate under optimum conditions to inhibit a drop in corrosion-resistance of a steel substrate due to fine cracks formed at a chromium layer, and to improve a hardness of the chromium layer. The heat-treating method comprises the steps of: plating the chromium layer onto the steel substrate; and heating the chromium-plated steel substrate in an oxidizing gas environment at above atmospheric pressure to form oxidized layers containing magnetite ($Fe_3O_4$) on the surface of the steel substrate, the surface of the steel substrate being partly exposed to the air through penetrating cracks formed in the chromium layer.

In accordance with the heat-treating method, the chromium-plated steel substrate having excellent corrosion- and wear-resistance can be easily obtained by plating chromium onto the steel substrate, followed by oxidizing the chromium-plated steel substrate. In addition, the heat-treating method contributes to fewer defects, low manufacturing costs and long life span of chromium plating-related products.

3 Claims, 2 Drawing Sheets

HEAT-TREATING METHOD FOR IMPROVING WEAR-RESISTANCE AND CORROSION-RESISTANCE OF CHROMIUM-PLATED STEEL SUBSTRATE

BACKGROUND OF THE INVENTION

Field of the Invention

The present invention relates to a heat-treating method for improving the wear- and corrosion-resistance of a chromium-plated steel substrate. More particularly, the present invention relates to a method for improving the wear- and corrosion-resistance of a chromium-plated steel substrate by heat-treating the chromium-plated steel substrate under optimum conditions to inhibit a drop in corrosion-resistance of a steel substrate due to fine cracks formed in a chromium layer, and to improve a hardness of the chromium layer as well.

In general, chromium platings, which have been widely used in various industrial and decorative fields, are largely classified into two categories: a hexa-valent chromium plating process and a tri-valent chromium plating process. The hexa-valent chromium plating process has been mainly applied since 1920s, while the tri-valent chromium plating process was recently developed to reduce environmental pollution.

In particular, since the chromium platings used for various industrial fields have excellent resistance to corrosion and wear, they are currently used in moldings, automobiles and various machine parts. In addition, decorative chromium platings exhibit higher excellent resistance to corrosion than any other metal plating.

The hexa-valent chromium plating is advantageous in terms of low-cost treatment and excellent resistance to corrosion, wear and heat. However, fine cracks are likely to occur in a hexa-valent chromium layer in view of properties intrinsic to the chromium plating. The fine cracks lower a resistance of the steel substrate to corrosion, which results in the steel substrate being rusted.

On the other hand, a tri-valent chromium layer exhibits a hardness similar to the hexa-valent chromium layer. Like the hexa-valent chromium layer, the tri-valent chromium layer has a low resistance to corrosion due to the presence of fine cracks formed therein. The hardness of the hexa-valent chromium layer is reduced by a relaxed residual stress inside the layer at high temperature. However, the hardness of the tri-valent chromium layer is increased by a small amount of carbon present in an organic complexing agent of a plating bath. That is, the carbon is incorporated into the tri-valent chromium layer, and the Cr—C platings thus formed are crystallized at high temperature to form highly hard chromium carbide precipitates such as $Cr_7C_3$, $Cr_{23}C_6$, etc. The precipitates increase the corrosion-resistance of the trivalent chromium layer. At this time, increased hardness due to precipitation of stable carbides improves wear-resistance of the tri-valent chromium layer.

Although the hardness and corrosion-resistance of the tri-valent chromium layer are increased as described above, corrosion-resistance of a tri-valent chromium-plated steel substrate is decreased due to the presence of fine cracks formed at the tri-valent chromium layer.

Therefore, the present invention has been made in view of the above problems, and it is an object of the present invention to provide a heat-treating method for improving the wear- or corrosion-resistance of a chromium-plated steel substrate by plating hexa-valent or tri-valent chromium onto a steel substrate, followed by oxidizing the surface of an steel substrate exposed to the air through fine cracks formed at a chromium layer to form $Fe_3O_4$ layers on the surface of the steel substrate. In accordance with the heat-treating method, the corrosion-resistance of hexa-valent chromium-plated steel substrate is improved, and the corrosion- and wear-resistance of tri-valent chromium-plated steel substrate are improved.

To achieve the above objective, there is provided a heat-treating method for improving the wear- and corrosion-resistance of a chromium-plated steel substrate, comprising the steps of:

plating a chromium layer onto an steel substrate; and heating the chromium-plated steel substrate in an oxidizing gas environment at above atmospheric pressure to form oxidized layers containing magnetite ($Fe_3O_4$) on the surface of the steel substrate, the surface of the steel substrate being partly exposed to the air through penetrating cracks formed in the chromium layer.

In accordance with the heat-treating method according to the present invention, the step of heating in an oxidizing gas environment to form oxidized layers is preferably carried out at 180~570° C. for 10~600 minutes.

The oxidized layers formed by heating in an oxidizing gas environment preferably contain magnetite ($Fe_3O_4$) in an amount of above 60% by weight.

The oxidizing gas used in the present invention is preferably steam, carbon dioxide, air, or mixtures thereof.

In accordance with one aspect of the present invention, the heat-treating method for improving the wear- and corrosion-resistance of the chromium-plated steel substrate further comprises the step of carbonitriding the chromium-plated steel substrate prior to heating in an oxidizing gas environment to form oxidized layers. The carbonitriding step permits formation of iron nitrides ($Fe_{2-3}N$) in the form of a $\epsilon$-phase on the surface of the steel substrate exposed to the air through fine cracks formed in the chromium layer.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Hereinafter, the present invention will be explained in more detail with reference to the accompanying drawings.

Figure 1:
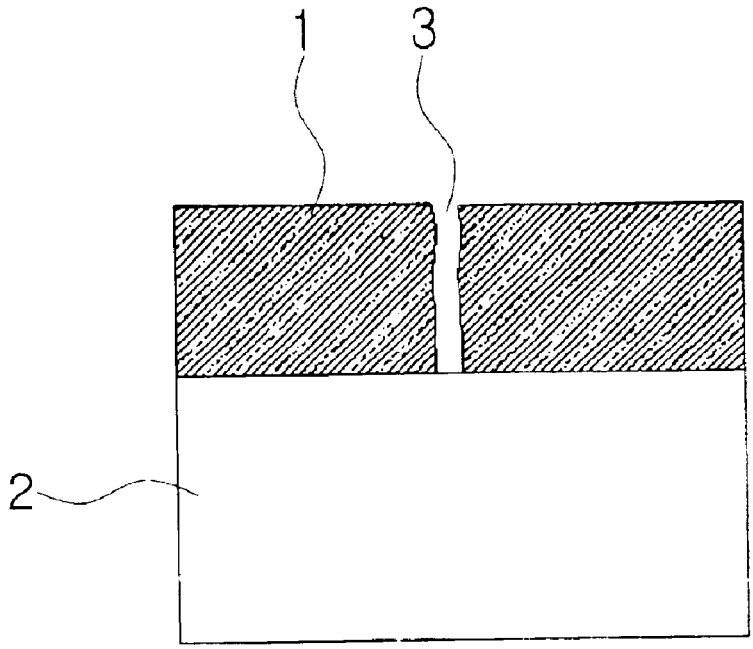
FIG. 1 is a cross-sectional view schematically showing a chromium-plated steel substrate in which a penetrating crack is formed, prior to applying a heat-treating method according to the present invention.
Figure 2:
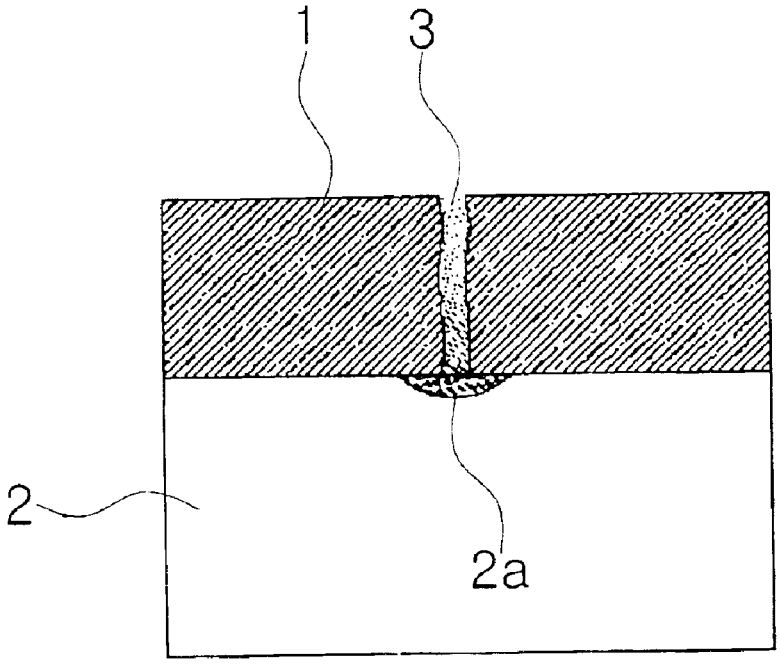
FIG. 2 is a cross-sectional view schematically showing a protective layer formed on the surface of an steel substrate by a heat-treating method for improving the wear- and corrosion-resistance of a chromium-plated steel substrate according to the present invention.

FIG. 1 is a cross-sectional view schematically showing a chromium-plated steel substrate in which a penetrating crack is formed, prior to applying the heat-treating method according to the present invention; and FIG. 2 is a cross-sectional view schematically showing a protective layer formed on the surface of an steel substrate by the heat-treating method for improving the wear- and corrosion-resistance of a chromium-plated steel substrate according to the present invention.

Generally, a hexa-valent chromium layer is formed on the surface of a steel substrate as follows. First, the steel substrate as a cathode and an insoluble anode are dipped in a plating bath consisting of anhydrous chromium trioxide ($CrO_3$) and water ($H_2O$). Electricity is then applied between the cathode and anode to form chromate ion ($CrC_4^{2-}$) through a chromic acid ($H_2CrO_4$) intermediate. The chromate ion ($CrO_4^{2-}$) is deposited on the surface of the steel substrate in the form of Cr metal. In the case of a tri-valent chromium layer, an organic compound such as formamide ($HCONH_2$) is further added as a carbon source to the plating bath.

As shown in FIG. 1, the chromium layer thus formed has fine cracks therein. The steel substrate is subjected to corrosion in a corrosive environment due to the fine cracks.

However, as shown in FIG. 2, formation of iron oxide ($Fe_3O_4$) or the surface of the steel substrate prevents the steel substrate from contacting with the corrosive environment. Iron oxide ($Fe_3O_4$) is a compound, which is highly resistant to corrosion. Accordingly, the hexa-valent chromium-plated steel substrate has excellent corrosion-resistance.

On the other hand, when the tri-valent chromium-plated steel substrate is oxidized at high temperature, crystallization occurs in the fine cracks formed at the chromium layer and carbon is bonded to Cr metal to form highly hard chromium carbides such as $Cr_7C_3$, $Cr_{23}C_6$, etc. Accordingly, the tri-valent chromium-plated steel substrate has improved wear-resistance.

As described above, when the hexa- or tri-valent chromium-plated steel substrate is heated in a furnace at 180~570° C. ° C. for 10~600 minutes, iron oxides including $Fe_3O_4$ as a main component are formed on the surface of the steel substrate which contacts with a corrosive environment through the fine cracks formed at the chromium layer.

When the oxidation of the chromium-plated steel substrate is carried out at a temperature lower than 180° C., the oxidation rate is so slow that the thickness of the oxidized layers formed is insufficient, and further the hardness of the tri-valent chromium layer is unsatisfactory.

When the oxidation of the chromium-plated steel substrate is carried out at a temperature higher than 570° C., wustite (FeQ) having low corrosion-resistance is formed on the surface of the steel substrate.

Examples of the furnace usable in the present invention include furnaces at 1~100 atm, vacuum furnaces at below atmospheric pressure and plasma furnaces. All these furnaces include oxidizing gas such as air, oxygen and steam, and preferably include steam.

With regard to a time for heat-treating the chromium-plated steel substrate, the heat-treatment is carried out for a time sufficient for the formation of the oxidized layer containing magnetite ($Fe_3O_4$) in an amount of above 60% by weight on the surface of the steel substrate. For example, at a heat-treatment temperature of 570° C., the chromium-plated steel substrate is heated for 10 minutes or longer and preferably 30 minutes to form desired oxidized layers. At 180° C., the chromium-plated steel substrate is heated for at least 600 minutes.

In addition, carbonitriding the chromium-plated steel substrate prior to oxidizing it leads to the formation of iron nitrides ($Fe_{2-33}N$) in the form of a ϵ-phase on the surface of the steel substrate exposed to a corrosive environment through fine cracks formed at the chromium layer. Accordingly, the carbonitrided chromium-plated steel substrate is highly resistant to corrosion.

Carbonitridation of the chromium-plated steel substrate is commonly carried out at 450~650° C. for 30~300 minutes. In particulary when carbonitriding at above 570° C., the oxidation of the chromium-plated steel substrate is preferably carried out at a temperature lower than 570° C.

EXAMPLE

Sargent bath ($CrO_3$ 250 g/l, $H_2SO_4$ 2.5 g/l) was used as a plating bath for plating hexa-valent chromium on a steel substrate, and a plating bath containing 150 g/l $CrO_3$, 1.5 g/l $H_2SO_4$ and 10~20 ml of formamide ($HCONH_2$) as a carbon source was used for plating tri-valent chromium on a steel substrate, respectively. Lead was used as anodes in both baths. Specimens for both chromium plating were subjected to reverse electrolysis at a current density of 10 A/dm$^2$ for 1 hour, followed by at a current density of 40~60 A/dm$^2$ and 45~55 A/dm$^2$ ° C. to obtain a hexa-valent and a tri-valent chromium-plated steel substrate, respectively.

Figure 3:
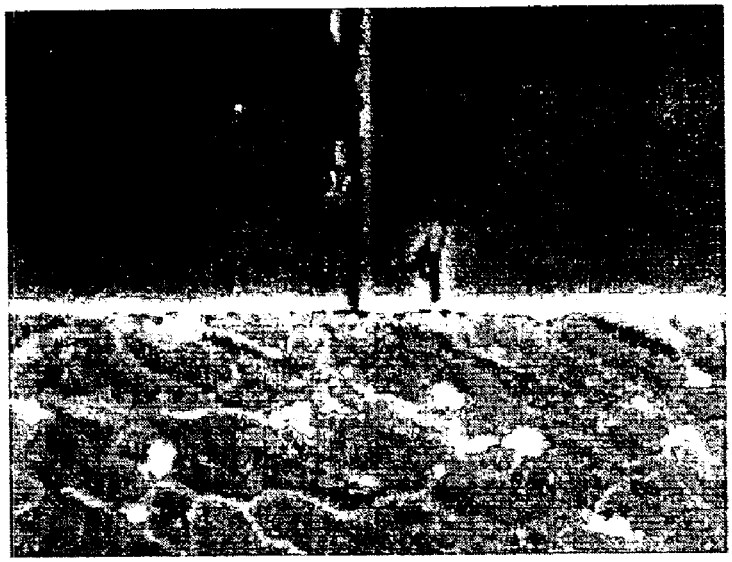
FIG. 3 is a scanning electron microscopic image showing a chromium-plated steel substrate in which penetrating cracks are formed, prior to applying a heat-treating method according to the present invention.
Figure 4:
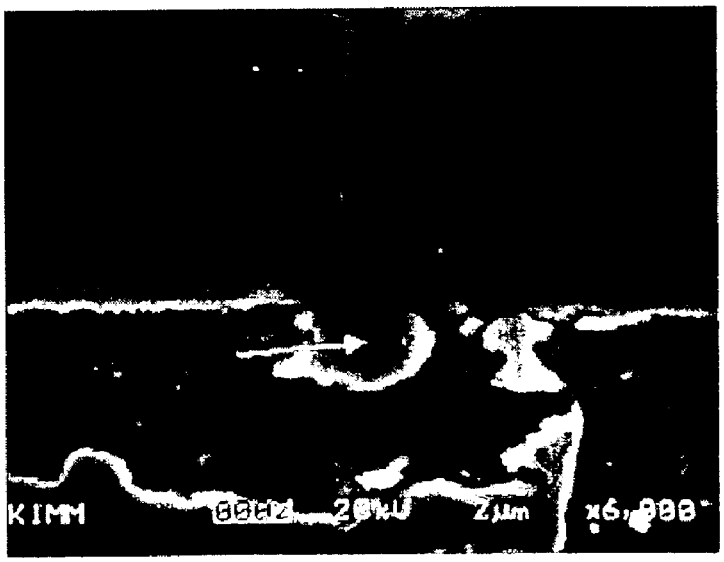
FIG. 4 is a scanning electron microscopic image showing protective layers formed on the surface of an steel substrate by a heat-treating method for improving the wear- and corrosion-resistance or a chromium-plated steel substrate according to the present invention.

FIG. 3 is a scanning electron microscopic image showing the chromium-plated steel substrate in which penetrating cracks are formed, prior to applying the heat-treating method according to the present invention; and FIG. 4 is a scanning electron microscopic image showing protective layers formed on the surface of the steel substrate by the heat-treating method for improving the wear- and corrosion-resistance of the chromium-plated steel substrate according to the present invention.

FIGS. 3 and 4 show cross-sectional views before and after the oxidation of the chromium-plated steel substrate, respectively. As shown in FIGS. 3 and 4, a number of fine cracks were observed in both the tri-valent and hexa-valent chromium layers.

Specimens of the tri-valent and hexa-valent chromium-plated steel substrate thus obtained were carbonitrided and then oxidized using steam under the conditions shown in Table 1 below. For comparison, specimens of the chromium plated steel substrate were directly oxidized using steam under the conditions shown in Table 1 below, without any carbonitriding step.

TABLE 1

Hardness and corrosion tests of tri-valent and hexa-valent chromium-plated steel substrate at various conditions for heat-treatment

| Types of chromium platings | Heat treatment conditions | Hardness (Test load 300 g) | Salt spray test | Remarks |
|---|---|---|---|---|
| Tri-valent chromium plating | Unoxidized | HV800 | Below 6 hrs. | Before treatment |
| | Oxidized at 150° C. for 10 hrs. | HV850 | 15 hrs. | Comparative example |
| | Oxidized at 180° C. for 10 hrs. | HV1000 | 60 hrs. | Inventive examples |
| | Oxidized at 250° C. for 5 hrs. | HV1500 | 150 hrs. | |
| | Oxidized at 350° C. for 3 hrs. | HV1790 | 500 hrs. | |

TABLE 1-continued

Hardness and corrosion tests of tri-valent and hexa-valent chromium-plated steel substrate at various conditions for heat-treatment

| Types of chromium platings | Heat treatment conditions | Hardness (Test load 300 g) | Salt spray test | Remarks |
|---|---|---|---|---|
| | Oxidized at 450° C. for 2 hrs. | HV1850 | 1000 hrs. | |
| | Carbon trided at 570° C. for 3 hrs., and then oxidized 520° C. for 30 min. | HV1830 | Above 1250 hrs. | |
| | Oxidized at 570° C. for 30 min. | HV1830 | Above 1030 hrs. | |
| | Oxidized at 600° C. for 30 min. | HV1850 | Below 10 hrs. | Comparative example |
| Hexa-valent chromium plating | Unoxidized | HV750 | Below 6 hrs. | Before treatment |
| | Oxidized at 150° C. for 10 hrs. | HV700 | 10 hrs. | Comparative example |
| | Oxidized at 180° C. for 10 hrs. | HV680 | 50 hrs. | Inventive examples |
| | Oxidized at 350° C. for 3 hrs. | HV657 | 450 hrs. | |
| | Oxidized at 450° C. for 2 hrs. | HV425 | 800 hrs. | |
| | Carbon trided at 570° C. for 3 hrs., and then oxidized 520° C. for 30 min. | HV360 | Above 1250 hrs. | |
| | Oxidized at 570° C. for 30 min. | HV385 | Above 1030 hrs. | |
| | Oxidized at 600° C. for 30 min. | HV380 | Below 10 hrs. | Comparative example |

As a result, the tri-valent chromium-plated steel substrate was observed to exhibit very high hardness of above HV1800, and excellent corrosion-resistance of 1030~1050 hours in a salt spray test, which demonstrates 170 times higher than the unoxidized chromium-plated steel substrate.

When the oxidation of the chromium-plated steel substrate was carried out at a temperature lower than 180° C., the oxidation rate was so slow that the thickness of the oxidized layers formed was insufficient, and further the hardness of the tri-valent chromium layer was unsatisfactory When the oxidation of the chromium-plated steel substrate was carried out at a temperature higher than 570° C., the chromium-plated steel substrate exhibited poor results in the salt spray test due to formation of wüustite (FeO) having low corrosion-resistance on the surface of the steel substrate Like tri-valent chromium-plated steel substrate, the hexa-valent chromium-plated steel substrate was observed to exhibit very high hardness of above HV380, and excellent corrosion-resistance of 1030~1050 hours in a salt spray test, which demonstrates 170 times higher than convenient hexa-valent chromium-plated steel substrate.

In particular, it was observed that the higher the oxidation temperature of the hexa-valent chromium-plated steel substrate was, the lower was the hardness of he hexa-valent chromium-plated steel substrate. Accordingly, appropriated reduction in the oxidation temperature of the hexa-valent chromium-plated steel substrate can lead to excellent corrosion-resistance without any influence on the hardness of the hexa-valent chromium-plated steel substrate.

Protective oxidized layers were formed by carbonitriding and oxidizing the chromium-plated steel substrate under the conditions shown in Table 1. FIG. 4 shows the protective oxidized layers (marked by arrow) consisting of iron nitrides ($Fe_{2-3}N$) in the form of a ϵ-phase and magnetite ($Fe_3O_4$) on the surface of the steel substrate exposed to the air through fine cracks formed at the chromium layer. Due to excellent corrosion-resistance of the protective oxidized layers, the chromium-plated steel substrate exhibits excellent corrosion-resistance, too.

As described above, the heat-treating method enabled the hexa-valent chromium-plated steel substrate to exhibit a corrosion-resistance 170 times higher than the unoxidized chromium-plated steel substrate. In particular, the tri-valent chromium-plated steel substrate exhibited very high hardness of above HV1800, and a corrosion-resistance 170 times higher than the unoxidized chromium-plated steel substrate.

In accordance with the heat-treating method according to the present invention, the chromium-plated steel substrate having excellent corrosion- and wear-resistance can be easily obtained by plat ing chromium onto the steel substrate, followed by oxidizing the chromium-plated steel substrate. Accordingly, additional steps including removing the chromium layer and re-plating chromium onto the steel substrate, which are problems of conventional chromium-plated steel substrate.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A heat-treating method for improving the wear- and corrosion resistance of a chromium plated steel substrate, comprising the steps of:

plating a chromium layer onto a steel substrate;

forming iron nitrides in the form of ϵ-phase ($Fe_{2-3}N$) by nitrocarburising at above atmospheric pressure on the portion of the steel substrate surface exposed to the air through fine cracks formed at the chromium layer; and forming iron oxides containing magnetite ($Fe_3O_4$) on the portion of the above iron nitrides in the form of ϵ-phase ($Fe_{2-3}N$).

2. The heat-treating method for improving the wear- and corrosion resistance of a chromium-plated steel substrate as set forth in claim 1, wherein the step of nitrocarburising is carried out by heating in a carbon and nitrogen gas atmosphere at 500~650° C. for 30~240 minutes.

3. The heat-treating method for improving the wear- and corrosion resistance of a chromium-plated steel substrate as set forth in claim 1, wherein the step of forming iron oxides is carried out by heating in a steam or air atmosphere at 350~560° C. for 10~180 minutes.

* * * * *